United States Patent [19]

Childs et al.

[11] Patent Number: 4,599,749

[45] Date of Patent: Jul. 15, 1986

[54] CAP FOR WOMEN TO CONCEAL HAIR LOSS

[75] Inventors: Margaret Childs; Kathryn R. Costikyan, both of Northfield, Ill.

[73] Assignee: Designs for Comfort, Inc., Northfield, Ill.

[21] Appl. No.: 801,301

[22] Filed: Nov. 25, 1985

[51] Int. Cl.[4] ..... A41G 5/00; A42B 1/16; A42B 1/24

[52] U.S. Cl. ..... 2/199; 2/204; 2/207; 132/53; D2/242

[58] Field of Search ..... 2/207, 199, 198, 204; 132/53, 54; D28/92, 93; D2/242, 239, 240, 241

[56] References Cited

U.S. PATENT DOCUMENTS

| | | | |
|---|---|---|---|
| D. 239,216 | 3/1976 | Kim et al. | D2/239 |
| 2,104,538 | 1/1938 | Goldsmith | 2/207 X |
| 2,567,119 | 9/1951 | Naidor | 132/53 X |
| 2,574,558 | 11/1951 | Graber et al. | 2/207 |
| 2,651,310 | 9/1953 | Selson | 2/199 X |
| 3,460,546 | 8/1969 | Abbott | 132/53 |
| 3,782,396 | 1/1974 | Tomlinson | 132/53 |
| 4,468,818 | 9/1984 | Flannery | 2/207 |
| 4,492,242 | 1/1985 | Dalton | 2/207 X |

FOREIGN PATENT DOCUMENTS

| | | | |
|---|---|---|---|
| 1248572 | 11/1960 | France | 132/53 |

*Primary Examiner*—Werner H. Schroeder
*Assistant Examiner*—Andrew M. Falik
*Attorney, Agent, or Firm*—McCaleb, Lucas & Brugman

[57] ABSTRACT

A cap for wear by women to conceal a partial or total hair loss. It comprises a main fabric piece with a curved top margin and a straight bottom margin with hems along both margins. A hairpiece retainer band consisting of a fabric strip is sewn at its opposite ends along the inside of the bottom hem and provides between itself and the bottom hem a space to retain a hairpiece simulating bangs. An elastic drawstring is provided in the top hem to gather the curved top margin into a tight loop creating many large folds in the top and back of the cap when worn to conceal the back of the head and give the appearance of a full head of hair while applying tension to the bottom margin and retainer band to hold the hairpiece in place in a readily adjustable manner. In one embodiment, both the main fabric piece and the retainer band are elastically stretchable only in a direction parallel to the bottom hem. In other embodiments, the main fabric piece is non-stretchable either parallel to or perpendicular to the bottom hem.

7 Claims, 9 Drawing Figures

48
20
28
34

48
20
48

48
FIG. 3 (OUTSIDE)
40½"
18"
44
22
20
14¼"
30
6
26
ELASTICALLY STRETCHABLE
28
27
3¾"
6
24
21"
32
32
20

36
34
38
32
28
26

36
34
38
22
44
42
8
8
20
26
27
36
7
28
30
24
34
FIG. 5 (INSIDE)
7

20
42
40
44

CAP FOR WOMEN TO CONCEAL HAIR LOSS

BACKGROUND OF THE INVENTION

This invention pertains generally to headware and particularly to a cap for temporary wear by women while they are recovering from a partial or total hair loss.

A side effect of chemotherapy is often a substantial or total loss of hair, a condition which may persist for several weeks or months during the treatment and afterward while new hair is growing. Another side effect is that the scalp is extremely tender and overly sensitive to wigs and conventional hairpieces which may be hot, scratchy or cumbersome and require considerable care and attention which would be objectionable to a patient undergoing or recovering from therapy. Further, it is not practical for a woman with hair loss to don a wig just to meet someone at the door or to run out for a quick shopping trip.

Conventional bandanas, scarves, turbans, babushkas and terry cloth head covers have been tried but they are often not very attractive and require constant attention to keep them from slipping over the ears or down the forehead. Further, they tend to conform to the scalp contour and so lack the full appearance which they would have if worn over a full head of hair.

Prior art includes U.S. Pat. No. 3,460,546 which shows a scarf or babushka with plural hair pieces attached to the underside and overlying the wearer's natural head of hair.

U.S. Pat. No. 3,782,396 discloses wigs and hats combined in different ways.

U.S. Pat. No. 2,651,310 has a decorative headband with bangs-type hair pieces attached to it.

U.S. Pat. No. 4,492,242 discloses a triangular scarf with a bangs-type hair piece extending below the forward edge. It is assembled by tying opposite corners together. It requires stitching along the edges of a rear triangular tab to cover the back of the head. It must be tied and untied with each use and does not provide the kind of fullness giving the appearance of an underlying full head of hair.

SUMMARY OF THE INVENTION

It is a general object of the present invention to provide a head cover or cap for women to cover a partial or total hair loss which has a readily adjustable bangs-type hairpiece, and is stylish, colorful, soft, porous and comfortable for extended wear on a sensitive scalp, fits snugly, does not itch or scratch, can be put on and removed quickly and easily, and effectively appears to cover a full head of hair.

An object of the invention is to provide a main fabric piece with a periphery including a curved top margin and a straight bottom margin with hems along both margins, a retainer band comprising an elongated fabric strip on the inside of the bottom hem providing between itself and the bottom hem a retainer space for a bangs-type hairpiece, a drawstring in the top hem effective when tightened to gather the curved top margin into a tight loop creating without stitching many large folds in the top and rear to conceal the back of the head and give the appearance of a full head of hair over the entire top, back and side areas while tensioning the bottom hem and retainer band to hold the hairpiece stably in place.

Another object is to provide the main fabric piece and the retainer band of materials which are selectively elastically stretchable either in a direction parallel to or perpendicular to the bottom margin so the cap fits snugly on the head without slipping and the hair piece is readily adjustable while the cap remains in place.

Another object is to provide the main fabric piece and the retaining band of materials which are elastically stretchable in a direction parallel to the bottom hem, but relatively less stretchable in a direction normal to the bottom hem, to provide a snug fit combined with dimensional stability and ready, manual adjustability of the hairpiece.

Another object is to provide the main fabric piece of non-stretchable material and the retainer band of material which is elastically stretchable only in a direction parallel to the bottom hem.

Another object is to provide the main fabric piece of non-stretchable material and the retainer band of material which is elastically stretchable only in a direction perpendicular to the bottom hem.

Another object is to provide the drawstring in the form of an elastic member.

Another object is to provide the main fabric piece with a top, semi-circular margin and a bottom, straight margin.

BRIEF DESCRIPTION OF THE DRAWINGS

Other objects and advantages will be apparent from the following description taken in connection with the accompanying drawings in which:

FIG. 3 is an outside plan view of the cap opened up and in flattened condition with dimensions indicated for a typical preferred embodiment which fits a wide range of head sizes;

FIG. 5 is an inside plan view showing the reverse of FIG. 3 in flattened condition with the hair piece of FIG. 4 shown in place;

DETAILED DESCRIPTION OF THE PREFERRED EMBODIMENT

Figures 1, 2, 4, 6, 7, 8, 9:
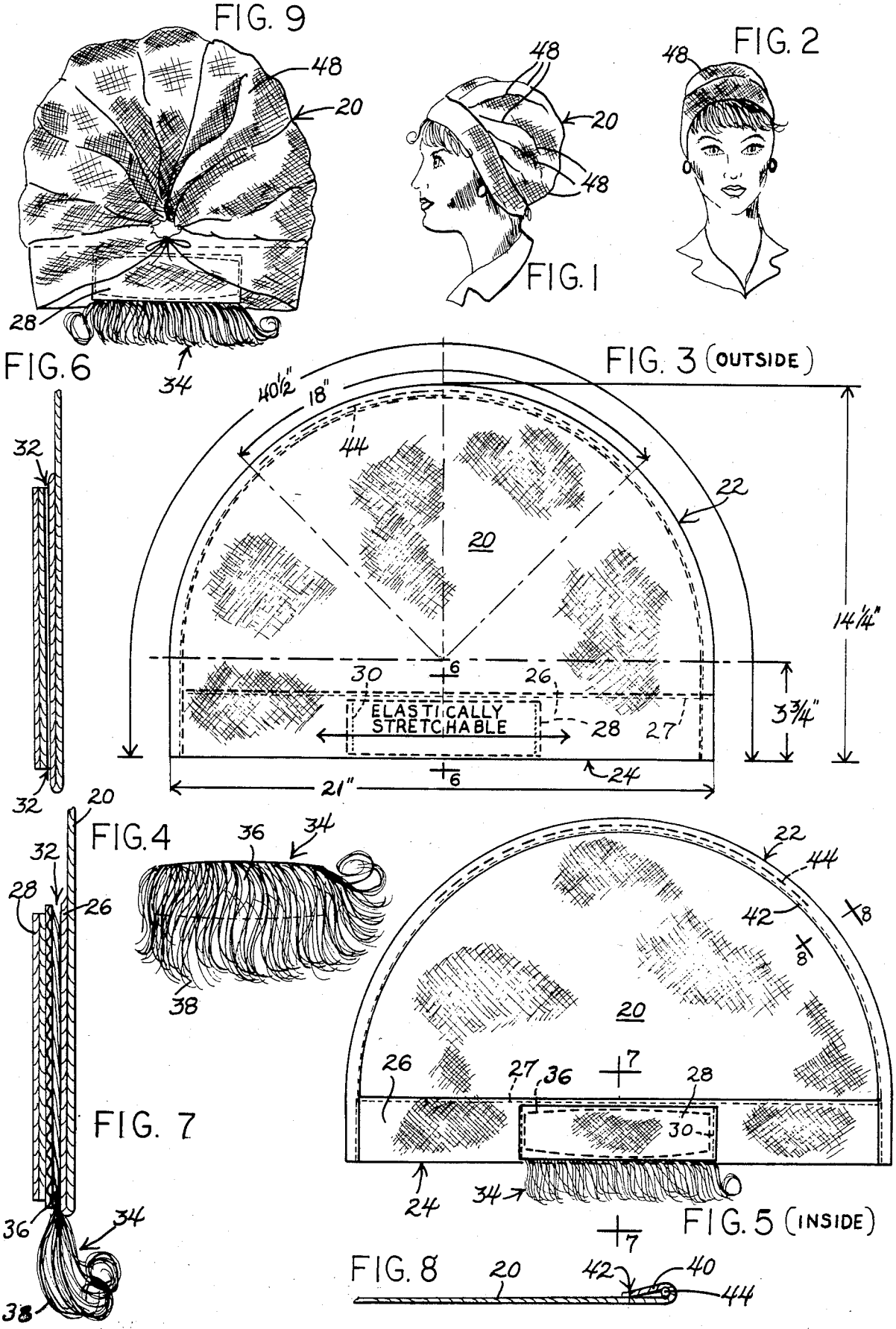
FIG. 1 is a side elevational view of one form of the cap of the present invention modeled by a user.
FIG. 2 is a front view of FIG. 1.
FIG. 4 is an outside plan view of a hair piece adapted to be worn with the cap.
FIG. 6 is a cross-section of FIG. 3 taken along line 6—6.
FIG. 7 is a cross-section of FIG. 5 taken along line 7—7.
FIG. 8 is a cross-section of FIG. 5 taken along line 8—8.
FIG. 9 is a view of the cap and hair piece combination assembled for use, laid flat and seen from the rear.

Referring now to the specific embodiment of the invention shown in the drawings, it comprises a main fabric piece 20 having a generally semi-circular shape with a periphery including a curved top margin 22 and a straight bottom margin 24. As best shown in FIGS. 3 and 5, there is a wide bottom hem 26 along the bottom margin to provide a lower marginal reinforcement and impart body to the lower edge portion when worn. The hem is sewed by a line of stitches 27.

A retainer band 28 consisting of an elongated, doubled fabric strip is centrally located along the inside of the bottom hem. Opposite ends are attached as by a line of sewing stitches 30. This provides a downwardly- and upwardly-open space 32 (FIGS. 6 and 7) not visible from the outside when worn.

A hairpiece simulating bangs is generally designated 34 and is best shown in FIG. 4. It may consist of a sheet 36 of mesh material firm enough to hold its shape, with synthetic hair fibers 38 attached to it in any suitable way. The sheet 36, while flexible, is relatively firm in both vertical and horizontal directions and is contained in the space 32 as best shown in FIG. 7. One feature of the invention is that the hairpiece 34 is held between the retainer band 28 and bottom hem 26 merely by the tension in those components when stretched over the wearer's forehead. It is not sewed or adhered in any special way. This provides a very stable positioning of the hair piece but enables the wearer to manually reposition it up or down in the retainer space 32 to adjust the length of hair fibers exposed without removing the cap.

A top hem 40, sewed along a line of stitches 42, follows the top margin 22 completely around from one end of the bottom margin 24 to the other. As best shown in FIGS. 3, 5, and 8, a drawstring 44, preferably elastic, is provided in the top hem. FIG. 3 illustrates specific dimensions for the main fabric piece 20 and the drawstring 44 when laid flat, and prior to fitting the hairpiece 34 and tightening the drawstring 44 to produce the head cover ready to wear as shown in FIG. 9. The invention is not limited to the dimensions and proportions shown in FIG. 3, but these illustrate one head cover which fits many women's head sizes and has had an enthusiastic reception in the marketplace.

A wide variety of fabric materials may be used as long as they have a soft surface and are tolerable to the scalp which is usually sensitive following chemotherapy. The main fabric piece 20 and the hairpiece 34 may be provided in a choice of colors to match the wearer's mood, age, the occasion, or the time of year. The main fabric piece 20 and retainer band 28 may be cotton polyester to provide warmth in cold weather. A porous, breathable polyester pointelle will be more comfortable for summer or extended wear indoors.

An important feature of the invention providing fit without readjusting the drawstring for different head sizes is that the cotton polyester or pointelle material referred to above may be substantially elastic and stretchable in a horizontal direction as shown in FIG. 3 while being relatively non-elastic and non-stretchable in the vertical direction. This horizontal elastic stretchability, parallel to the bottom margin, and the elasticity of the drawstring 44 enables one size head cover to fit a wide range of head sizes and to hold the hairpiece 34 in the retaining space 32 by the tension of fabric contacting it on both sides. The wide, lower band structure provided by the bottom hem 26, coupled with the relative non-stretchability in a direction perpendicular to the bottom hem, provides dimensional stability and enables the cap to stay in place without creeping forward or backward when worn for extended periods.

Alternatively, the main fabric piece 20 may be made of a non-elastic fabric such as cotton broadcloth or the like and used in conjunction with a retainer band 28 and drawstring 44 as described. In this case, where the main fabric piece is non-stretchable in either direction, it is important that the retainer band be elastically stretchable in one direction but not stretchable in the other direction. That is, it may be stretchable parallel to the bottom hem and non-stretchable perpendicular to the bottom hem; or it may be elastically stretchable perpendicular to the bottom hem and non-stretchable parallel to it.

Thus, in practicing the present invention, the main fabric piece 20 and retainer band 28 may be selectively combined of elastically stretchable and non-stretchable materials as summarized in the chart below:

| Main fabric piece 20 | Retainer band 28 |
|---|---|
| Elastically stretchable parallel to bottom hem 26 and relatively non-stretchable perpendicular to bottom hem | same |
| Non-stretchable in in either direction | Elastically stretchable parallel to bottom hem and relatively non-stretchable perpendicular to bottom hem |
| | Non-stretchable parallel to bottom hem and relatively elastically stretchable perpendicular to bottom hem |

When the drawstring 44 is tightened to provide a minimum loop 46 at the back, it will gather the entire fabric piece 20 into a plurality of overlapping folds 48 extending uniformly over the top and back and sides as shown in FIGS. 1, 2 and 9 to provide a desirable full appearance over the entire head area.

The embodiments of the invention described and shown have been necessarily specific for purposes of illustration. Alterations and modifications will be apparent to those skilled in the art. The aim of the appended claims, therefore, is to cover all variations included within the spirit and scope of the invention.

The embodiments of the invention in which an exclusive property or privilege is claimed are defined as follows:

1. A cap for wear by women to conceal hair loss comprising:

a main fabric piece with a periphery including a curved top margin and a straight bottom margin;

a bottom hem along the inside of the bottom margin to engage the wearer's forehead when worn;

a retainer band consisting of an elongated fabric strip centrally located along the inside of the bottom hem with opposite ends of the strip attached to the bottom hem to provide between itself and the bottom hem an upwardly and a downwardly open space, said retainer band not being visible from the outside when worn;

a hairpiece simulating bangs removably located in said space and projecting downwardly beyond the bottom hem;

a top hem along the inside of the curved top margin; and a drawstring in the top hem effective when tightened to gather said curved top margin into a tight, multifolded loop at the lower nape of a wearer's neck to conceal the back of the head area and to provide multiple folds giving the appearance of a full head of hair while applying tension to the bottom hem and retainer band to retain the hairpiece in said space against the forehead.

2. A cap according to claim 1 in which the main fabric piece and the retainer band are elastically stretchable in a direction parallel to the bottom hem and are relatively non-stretchable in a direction perpendicular to the bottom hem.

3. A cap according to claim 1 in which the main fabric piece is non-elastic in both directions parallel to and perpendicular to the bottom hem and the retainer band is elastically stretchable in one of those directions but not in the other.

4. A cap according to claim 3 in which the retainer band is elastically stretchable only in the direction parallel to the bottom hem.

5. A cap according to claim 3 in which the retainer band is elastically stretchable only in the direction perpendicular to the bottom hem.

6. A cap according to claim 1 in which the curved top margin is generally semi-circular.

7. A cap according to claim 1 in which the drawstring is elastically stretchable.

* * * * *